US009332834B2

(12) United States Patent
Merey

(10) Patent No.: US 9,332,834 B2
(45) Date of Patent: May 10, 2016

(54) FOLDABLE TABLE HAVING LEGS OF UNEQUAL LENGTH

(71) Applicant: Thomas G. B. Merey, Ontario (CA)

(72) Inventor: Thomas G. B. Merey, Ontario (CA)

( * ) Notice: Subject to any disclaimer, the term of this patent is extended or adjusted under 35 U.S.C. 154(b) by 0 days.

(21) Appl. No.: 14/673,893

(22) Filed: Mar. 31, 2015

(65) Prior Publication Data

US 2015/0272315 A1 Oct. 1, 2015

(30) Foreign Application Priority Data

Apr. 1, 2014 (CA) ..... 2848519

(51) Int. Cl.

| | |
|---|---|
| ***A47B 3/00*** | (2006.01) |
| ***A47B 3/091*** | (2006.01) |
| ***A47B 3/08*** | (2006.01) |
| *A47B 21/06* | (2006.01) |

(52) U.S. Cl.

CPC ..... *A47B 3/0918* (2013.01); *A47B 3/0818* (2013.01); *A47B 2021/066* (2013.01)

(58) Field of Classification Search

CPC ..... A47B 38/00; A47B 38/002; A47B 38/02; A47B 38/08; A47B 38/091; A47B 13/02; A47B 37/00; A47B 21/02; A47B 2003/02; A47B 2003/025; A47B 2009/006

USPC ..... 108/115, 118, 121, 122, 124, 125

See application file for complete search history.

(56) References Cited

U.S. PATENT DOCUMENTS

| | | | | |
|---|---|---|---|---|
| 5,390,999 | A * | 2/1995 | Fuller | A47B 83/008 297/377 |
| 6,314,892 | B1 * | 11/2001 | Favini | A47B 3/002 108/115 |
| 6,494,419 | B2 * | 12/2002 | Pai | A45D 19/04 108/132 |
| 2005/0150724 | A1 * | 7/2005 | Snider | B25H 1/04 182/129 |
| 2008/0092786 | A1 * | 4/2008 | Chen | A47B 3/08 108/131 |
| 2010/0186640 | A1 * | 7/2010 | Leng | A47B 3/02 108/119 |
| 2011/0155021 | A1 * | 6/2011 | Geitner | A47B 3/08 108/25 |

* cited by examiner

*Primary Examiner* — Daniel Rohrhoff

(74) *Attorney, Agent, or Firm* — Young & Thompson

(57) ABSTRACT

The foldable table has a flat table top and a pair of leg assemblies which fold inward from an operative position to an inoperative position. The leg assemblies are pivotal about separate axes which are spaced an unequal distance from the table top. When the leg assemblies are folded in an inoperative position, both of the leg assemblies lie parallel to each other and to the table top.

8 Claims, 7 Drawing Sheets

FOLDABLE TABLE HAVING LEGS OF UNEQUAL LENGTH

FIELD OF THE INVENTION

This invention relates to folding tables and more particularly to a folding table having legs which fold together compactly in order to reduce the space occupied by the table when not in use.

BACKGROUND OF THE INVENTION

A folding table is conventionally composed of a table top and legs which are pivotally attached along its periphery. The table is folded by rotating or folding the legs inward until they are close to the underside of the table top. The table can then be stored in a space significantly smaller than the space occupied by the table when the legs are unfolded. However the folded legs still add significantly to the space occupied by the table. That is because the folded legs do not rest flat against the table top but are angled out from it. The more the legs, the greater the angle of the outermost leg from the underside of the table top. The angled legs add significantly to the space occupied by the table.

I have invented a folding table in which the legs when folded are either flat against the underside of the table top or parallel and very close to the underside. The space occupied by the legs is significantly less than the space of a conventional folding table of the same size.

SUMMARY OF THE INVENTION

Briefly my foldable table comprises: a planar table top having parallel oppositely facing upper and lower surfaces and larger and smaller leg assemblies. The leg assemblies each have a floor-contacting surface and each is pivotal with respect to the table top from an operative position in which the leg assemblies are unfolded and support the table top in a position for use to an inoperative position in which the leg assemblies are folded flat against the table top. The larger and smaller leg assemblies are pivotal about separate axes. One axis is spaced apart from the underside of the table top a distance smaller than the space between the other axis and the underside The larger leg assembly, when the larger and smaller leg assemblies are in the inoperative position, lies adjacent to and between the underside of the table top and the smaller leg assembly.

DESCRIPTION OF THE DRAWINGS

The folding table of the invention is described in detail with reference to the accompanying drawings in which.

Like reference characters refer to like parts throughout the description of the drawings.

DESCRIPTION OF THE PREFERRED EMBODIMENTS

With reference to FIGS. 1*a* to 1*d*, the folding table, generally 10 has a planar table top having parallel oppositely facing upper and lower surfaces 10*a, b*, respectively. The table top is supported by a pair of leg assemblies, generally 12, 14 and the assemblies rest on feet 16 attached to threaded studs 18 to facilitate the adjustment of the height of the table top in the conventional manner. Preferably, the leg assemblies are constructed of tubular steel for the sake of lightness of weight and economy of construction.

Figure 1D:
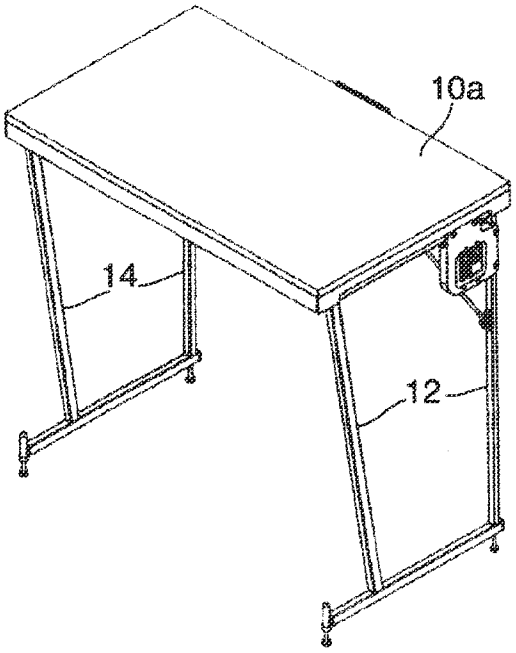
FIG. 1*d* is a perspective view of the folding table from the front.
Figure 1B:
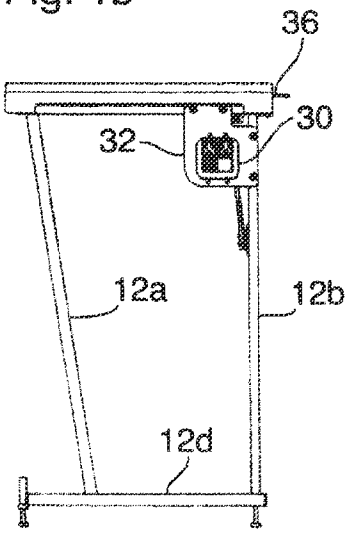
FIG. 1*b* is an elevation of the folding table from one or its sides.
Figure 1A:
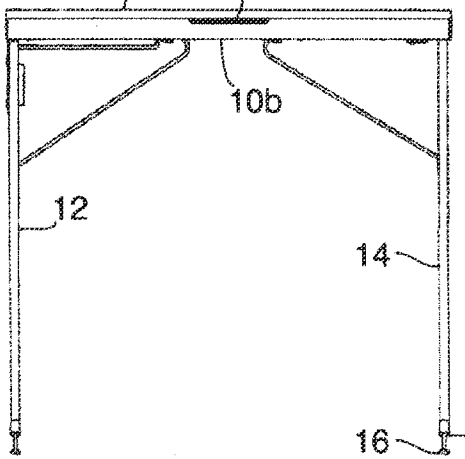
FIG. 1*a* is an elevation of the folding table from the rear.
Figure 1C:
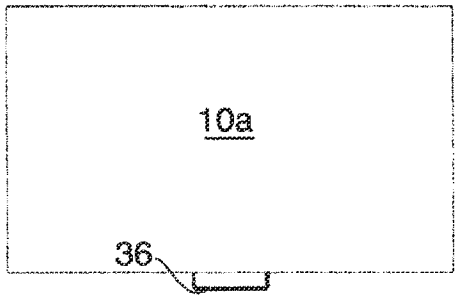
FIG. 1*c* is a plan view of the folding table.
Figure 2:
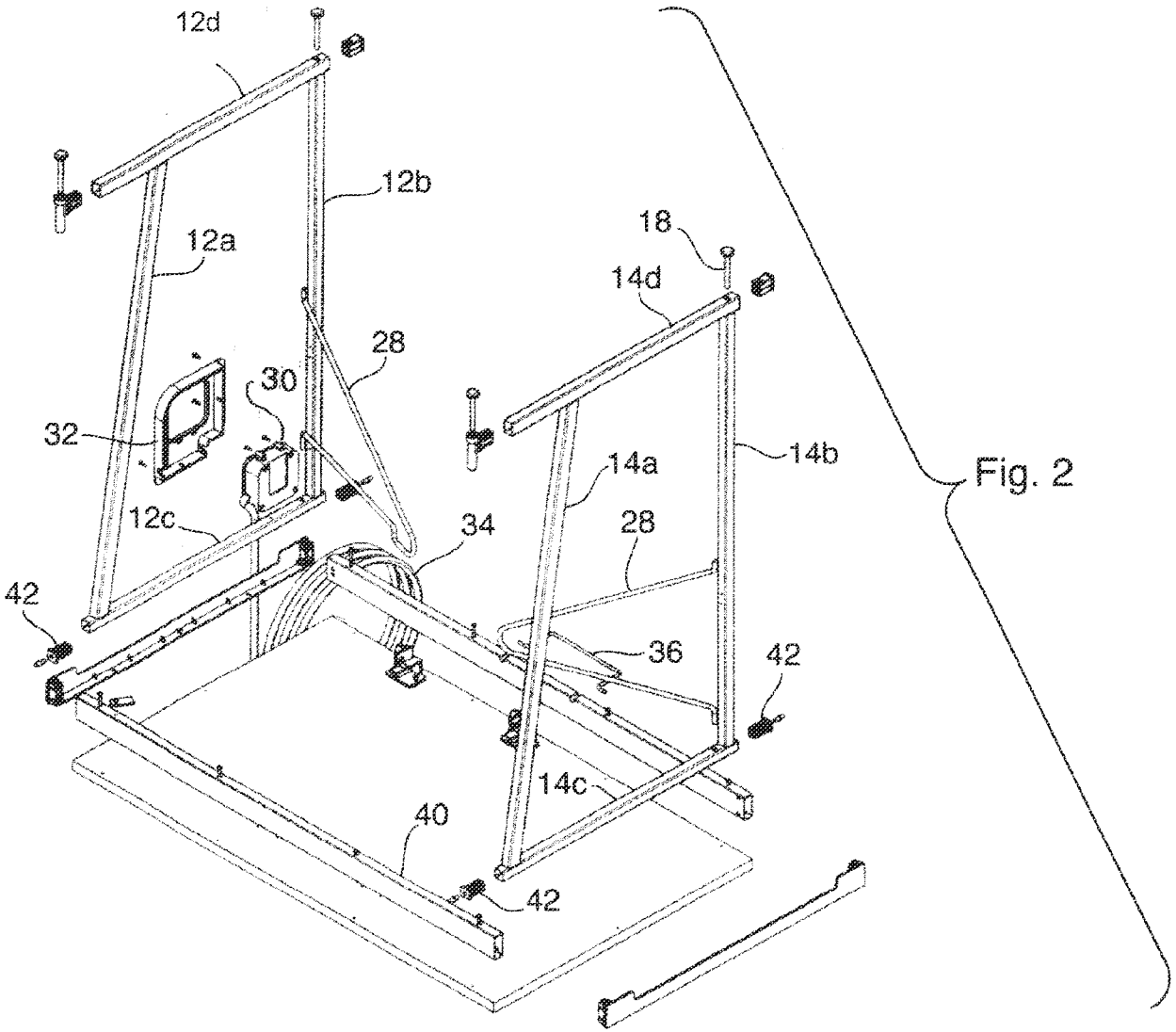
FIG. 2 is an exploded perspective view of the underside of the folding table.

With reference to FIGS. 1 and 2, the leg assemblies are provided with forward and rear legs 12*a,b* and 14*a,b* respectively which are interconnected at the top by upper webs 12*c*, 14*c* respectively, and at the bottom by lower webs 12*d*, 14*d*, respectively. The legs in each leg assembly accordingly fold as a unit.

Braces 28 are attached to the rear legs 12*b*, 14*b* for selectively immobilizing the leg assemblies relative to the table top. The operation of the braces is described below.

Preferably the folding table is provided with an array 30 of one or more electrical outlets to receive the plug of a computer, a desk lamp and any other electrical appliance that might rest on the table top The array of outlets is contained in a housing 32. The outlets in the array are connected to a source of electrical power by means of an electrical wire 34. The table is also provided with a handle 36 for carrying the table when it is folded.

Figure 3:
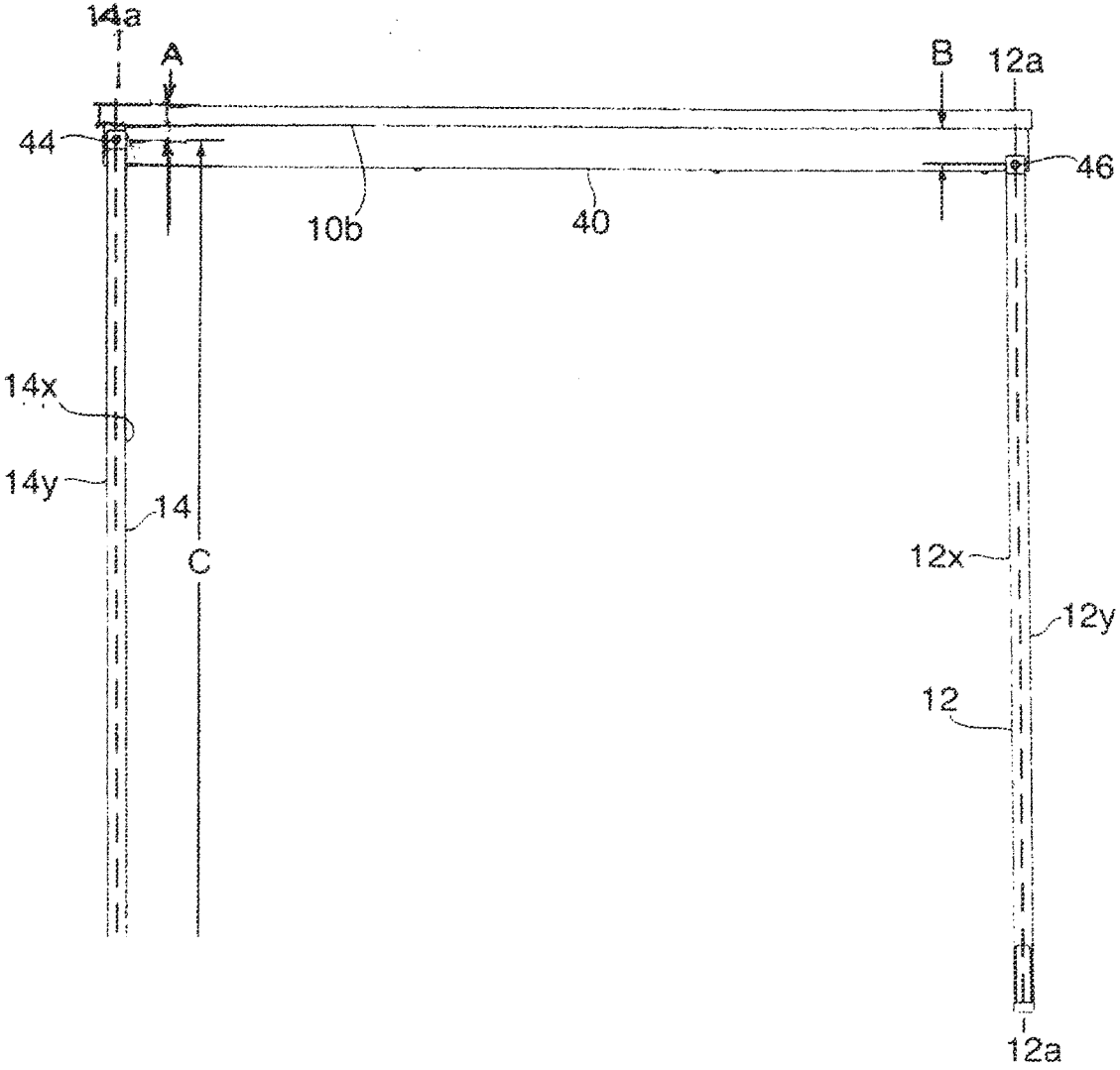
FIG. 3 is a simplified elevation in larger scale of the folding table in an operative position and in the absence of braces.

With reference to FIGS. 2 and 3, the leg assemblies are attached to a frame 40 beneath the table top. Attachment is by means of pivotal connections or swivels 42. Leg assembly 14 pivots about a first axis 44 relative to the table top while leg assembly 12 is pivots about a second axis 46 relative to the table top. The two axes are spaced an unequal distance from the table top. In FIG. 3, the distance "A" between the first axis 44 and the lower surface 10*b* of the table top, measured perpendicular to the table top is less than the distance "B" between the second axis 46 and the lower surface of the table top.

Since the distances between the two axes and the table top being different, the lengths of the two leg assembly are also different otherwise the table top would not be level when the table was unfolded. Axis 44 being closer to the table top, than axis 46, leg assembly 14 must be longer than assembly 12. The length of leg assembly 14 is marked C in FIG. 3 and is the vertical distance between axis 44 to which the leg is attached and the floor-contacting surface 16*a* of the leg when the subject folding table is unfolded for use. The length is measured on the longitudinal axis of each leg in the assembly. Accordingly the length of leg 14 in FIG. 3 is measured on the longitudinal axis 14*a*-14*a* and the length of leg assembly 12 is measured on its longitudinal axis 12*a*-12*a*.

Figure 4:
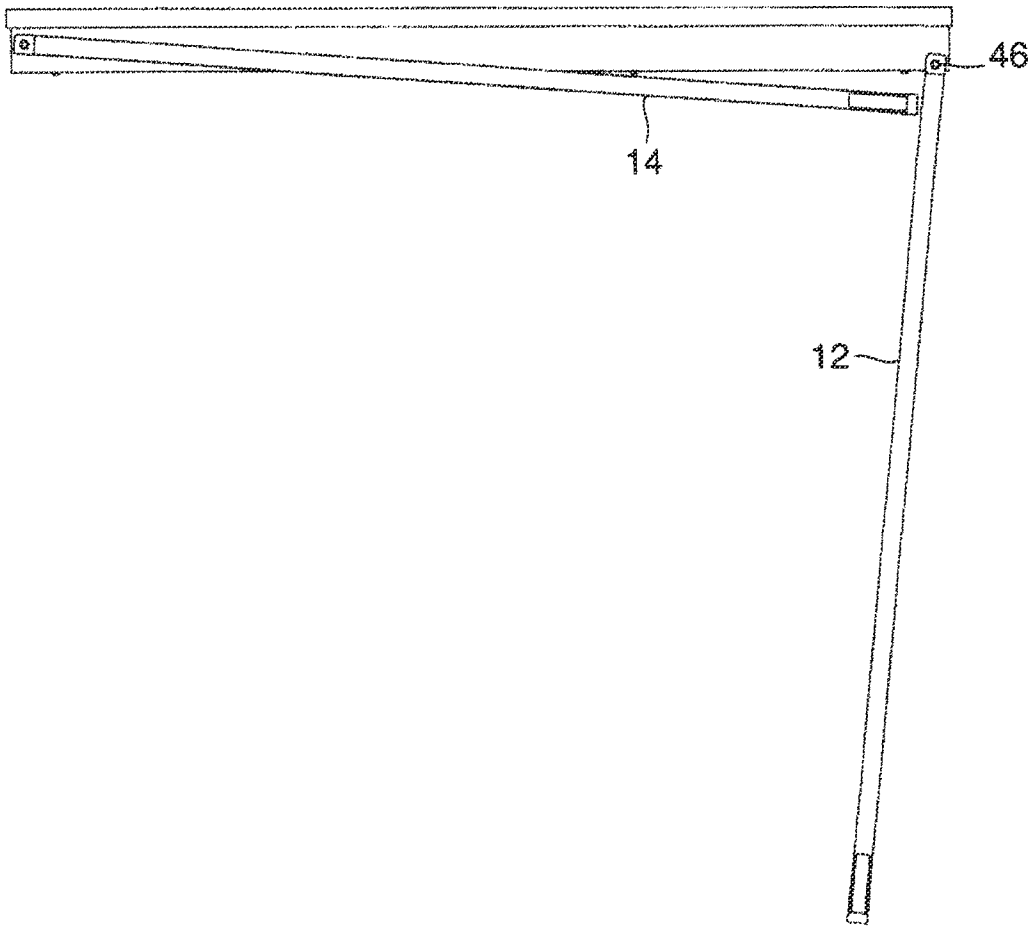
FIG. 4 is another simplified elevation of the folding table in the absence of braces as it is being folded into an inoperative position.
Figure 5:
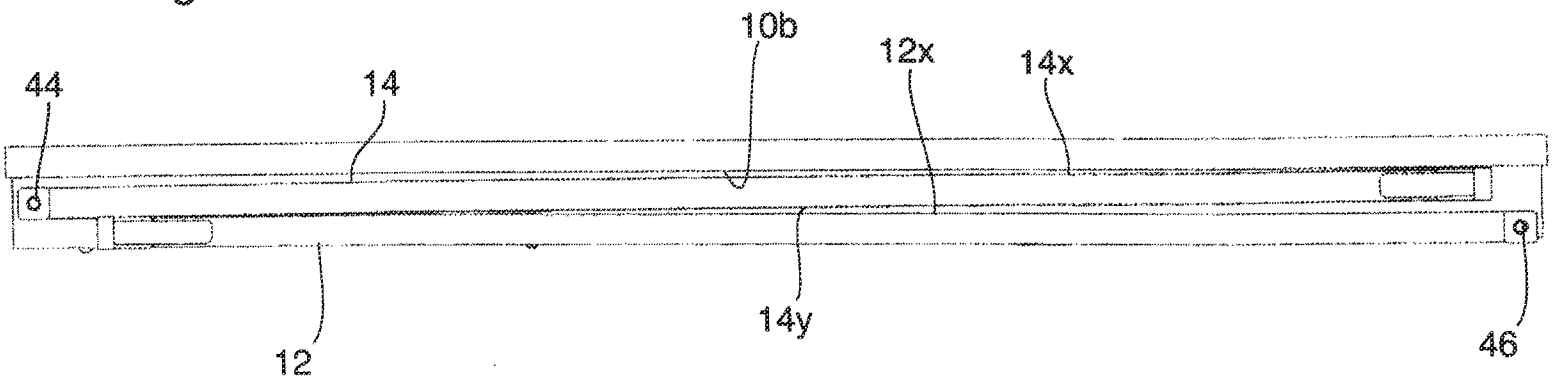
FIG. 5 is an elevation of the folding table in a fully folded or inoperative position.
Figure 6D:
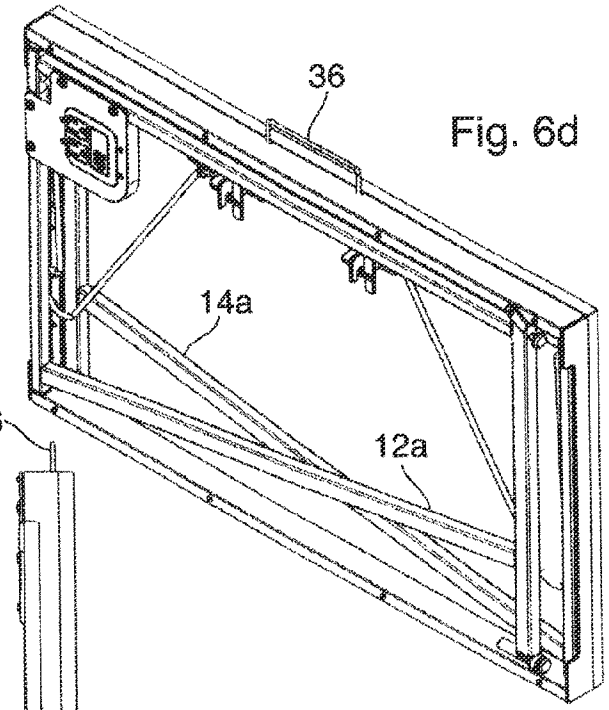
FIG. 6*d* is a perspective view of the underside of the folding table fully folded in an inoperative position.
Figure 6C:
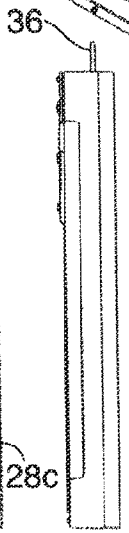
FIG. 6*c* is a view of a side wall of the folding table fully folded in an inoperative position.
Figure 6A:
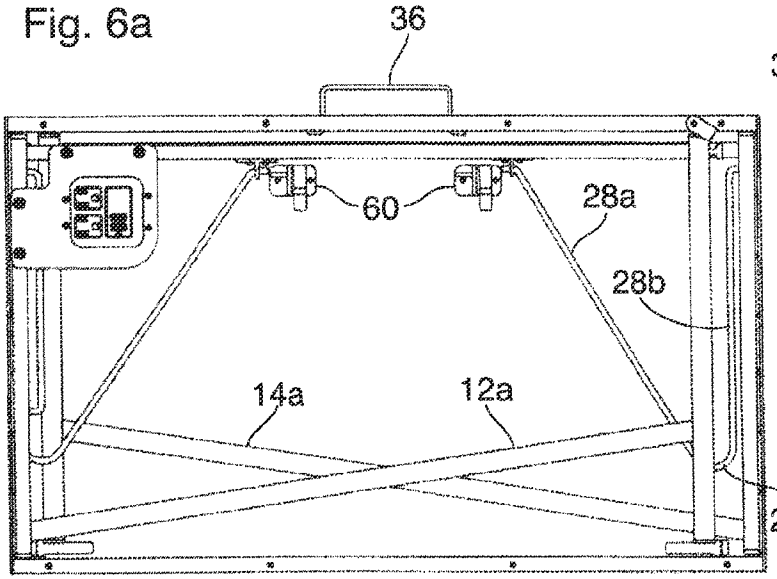
FIG. 6*a* is a view of the underside of the folding table in an inoperative position.
Figure 6B:
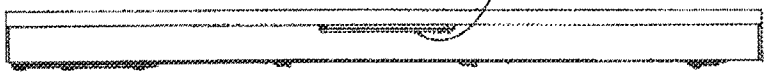
FIG. 6*b* is a side view of the rear wall of the folding table fully folded in an inoperative position.
Figure 8:
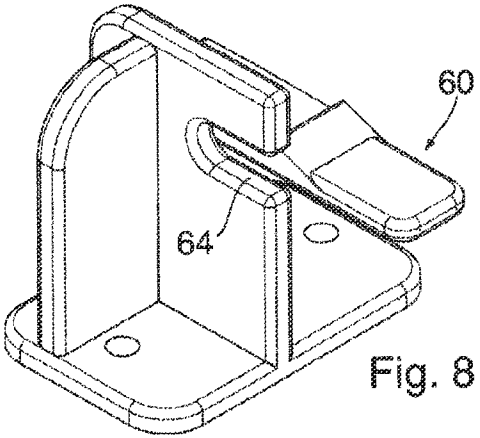
FIG. 8 is a perspective view of the brace lock.

With reference to FIGS. 4-6, as a result of the unequal spacing of the first and second axes from the lower and upper surfaces of the table top, the legs of the larger leg assembly 14, when folded inward to an inoperative position, fit into the space above the second axis 46. While in the space the legs of assembly 14 are adjacent to the lower surface 10*b* of the table top along its entire length. The legs of the shorter leg assembly 12 are adjacent to the legs of the longer leg assembly 14 along their entire lengths as illustrated in FIG. 5. The longitudinal axes of the longer and shorter leg assemblies are accordingly parallel to one another and to the upper and lower surfaces of the table top. The table top and the legs are side by side and no space is wasted between them. The result is that the folding table, when in an inoperative position, is compact and adapted to fit into confined spaces.

It will be observed from FIGS. 3 and 5 that the inwardly facing side walls 14*x* of the legs of the longer leg assembly when in a folded state lie adjacent to the lower surface 10*b* of the table top throughout their lengths while the inwardly facing side walls 12*x* of the legs of the shorter leg assembly lie adjacent to the outwardly facing side walls 14*y* of the larger leg assembly throughout their lengths. In other words, the upper and lower surfaces lie in parallel planes and the longitudinal axes of the two leg assemblies are parallel to those planes when the leg assemblies are folded together in an inoperative state beneath the table top.

Unfolding of the leg assemblies involves first rotating the shorter leg assembly followed by rotating the longer assembly until they are both oriented at 90 degrees relative to the planes of the table top. When the table top is then placed on a flat, level surface the legs will then appear as illustrated in FIG. 1*a*.

With reference to FIGS. 2 and 6-8, braces 28 are somewhat V in shape having a pair of legs 28*a,b* which intersect at an apex 28*c*. The legs are pivotally mounted to the rear legs of the leg assemblies and when the leg assemblies are unfolded, the apices of the braces come into contact with separate brace locks, generally 60. The brace locks are attached to the under or lower surface 10*b* of the table top.

Figure 7:
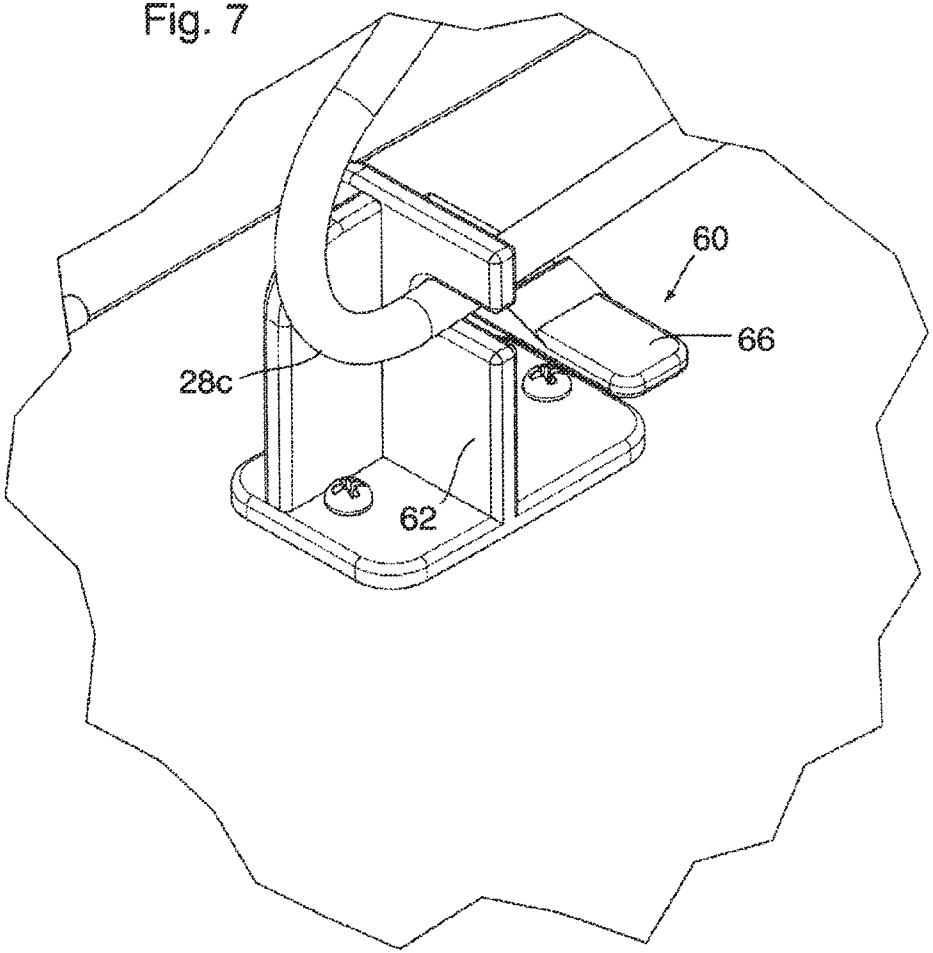
FIG. 7 is an enlarged perspective view of a brace lock in combination with a portion of a brace.

Each brace lock is provided with a wall 62 which extends outwardly from the under surface of the table top. A slot 64 is formed in the wall for removable receipt of the apex of the brace. The apex is removably locked in the slot as illustrated in FIG. 7 by means of a keeper 66. The keeper is resiliently biased into contact with the apex and functions to limit movement of the brace relative to the table top in order to stabilized the table when it is unfolded. The apex of the brace can be removed from the brace lock simply by applying pressure on the keeper opposed to its bias to widen the slot in which the brace is received.

It will be understood, of course, that modification can be made in the embodiments of the folding table of the invention without departing from the scope and purview of the invention as defined in the appended claims.

I claim:

1. A foldable table comprising:

a planar table top having oppositely facing upper and lower surfaces;

longer and shorter leg assemblies each having a floor-contacting surface and each being pivotal with respect to said table top from an operative position in which said leg assemblies support said table top in a horizontal position for use to an inoperative position in which said table top and said leg assemblies are folded together for storage, said longer and shorter leg assemblies being pivotal about first and second axes, respectively, said first axis being spaced apart from said upper surface of said table top a distance less than the distance between said second axis and said upper surface, said distances being measured perpendicular to said upper surface, said longer leg assembly, when said longer and shorter leg assemblies are in said inoperative position, lying adjacent to and between said lower surface of said table top and said shorter leg assembly;

a pair of braces each pivotal relative to a separate said leg assembly and each removably attached to said lower surface of said table top when each said leg assembly is in said operative position; and brace-locks for removably attaching said braces to said lower surface of said table top, wherein each said brace-lock has a slot in which a portion of a separate said brace is accommodated when said brace is attached to said lower surface, said brace-lock further including a resilient keeper which moves into frictional engagement with said brace portion when accommodated in said slot for minimizing movement of said brace portion relative to said brace-lock.

2. The foldable table of claim 1 wherein said longer and shorter legs assemblies each have oppositely facing inwardly and outwardly facing side walls, said inwardly facing side wall of said longer leg assembly, when in said inoperative position, lying adjacent to said lower surface of said table top throughout the length of said longer leg assembly while said inwardly facing side wall of said shorter leg assembly lying adjacent to said outwardly facing side wall of said longer leg assembly throughout the length of said shorter leg assembly.

3. The foldable table of claim 1 wherein each said leg assembly has a length from its respective said axis to its respective said floor-contacting surface, the elevation of said axes being adjusted relative to each other such that said upper surface of said table top is oriented horizontally in use when said floor-contacting surfaces of both said leg assemblies rest on a level surface.

4. The foldable table of claim 1 wherein said upper surface of said table top lies in a plane and wherein said longer and shorter leg assemblies have longitudinal axes which extend from said first and second axes, respectively, to said floor-contacting surfaces of each said first and second leg assemblies, said longitudinal axes of said first and second leg assemblies being parallel to said plane when said leg assemblies are in said inoperative position.

5. The foldable table of claim 1 wherein each said leg assembly has a length from its respective said axis to its said floor-contacting surface, the lengths of said longer and shorter leg assemblies being unequal and adjusted such that said upper surface of said table top is oriented horizontally in use when said floor-contacting surfaces of both said leg assemblies rest on a level surface.

6. The foldable table of claim 1 including means for adjusting the length of said leg assemblies when in said operative position with resulting adjustment in the elevation of said table top.

7. The foldable table of claim 1 including at least one electrical outlet on one said leg assembly for receipt of a plug for an electrical appliance.

8. The foldable table of claim 7 wherein said at least one electrical outlet is arranged adjacent to a plurality of other electrical outlets.

* * * * *